US006561311B2

(12) United States Patent
Chuang

(10) Patent No.: US 6,561,311 B2
(45) Date of Patent: May 13, 2003

(54) SPEAKER CABINET

(76) Inventor: Po-An Chuang, 12F-2, No. 376, Tun HWA South Road, Sec. 1., Taipei (TW)

( * ) Notice: Subject to any disclaimer, the term of this patent is extended or adjusted under 35 U.S.C. 154(b) by 0 days.

(21) Appl. No.: 09/931,906

(22) Filed: Aug. 20, 2001

(65) Prior Publication Data

US 2003/0034199 A1 Feb. 20, 2003

(51) Int. Cl.[7] ..... A47B 81/06

(52) U.S. Cl. ..... 181/199; 181/148; 181/149; 181/156; 181/198; 381/348; 381/349; 446/397; D14/204

(58) Field of Search ..... 181/199, 148, 181/156, 198, 149; 381/348, 349; 446/397; D14/204

(56) References Cited

U.S. PATENT DOCUMENTS 5,291,559 A * 3/1994 Freadman ..... 181/144
5,819,163 A * 10/1998 Tsukamoto et al. ..... 455/348
6,411,720 B1 * 6/2002 Pritchard ..... 181/156

* cited by examiner

*Primary Examiner*—Robert E. Nappi
*Assistant Examiner*—Renata McCloud
(74) *Attorney, Agent, or Firm*—Dennison, Schultz & Dougherty

(57) ABSTRACT

An improved structure of speaker cabinet comprising a housing opened on one side thereof, and comprising a front panel, wherein, a plurality of intermediate speakers can be held firm and get increased connecting strength when the front panel is integrally connected with the housing to thereby offset the frontward and rearward thrusts of the speakers. Moreover, a plurality of hollow posts located at the positions in correspondence with those of the connecting areas of the speakers to the cabinet can be filled therein with vibration absorbing material in order to reduce vibration at the earliest time. Such a design not only can reduce volume and weight of the cabinet, but also can improve sound quality and provide a hidden port to improve beauty and waterproofing effect of the cabinet.

2 Claims, 3 Drawing Sheets

SPEAKER CABINET

BACKGROUND OF THE INVENTION

1. Field of the Invention

The present invention is related to improvement of a speaker cabinet, and especially to improvement of a speaker cabinet which can increase connecting strength of the cabinet, improve quality of sound and beauty as well as water-proofing by providing a hidden port.

2. Description of the Prior Art

A speaker cabinet is a terminal equipment for sound outputting, in addition to being used for sound outputting, it can be used to decorate and to make outstanding of the entire modeling of the speaker cabinet, the appearance of it can be various to elevate the style of a hi-fi set. A conventional speaker cabinet structurally is comprised basically of a rear cabinet, a panel, a front barrier and inner speakers. The panel is provided with speakers which are connected with the speaker cabinet, and is provided with connecting points or a frame to movably connect with the front barrier in order to obscure the speakers against exposing, and the appearance and color of the front barrier can be variant to obtain different modeling. Quality of sound of a speaker cabinet can not only be determined by the fineness of out put signal curves of the inner horn, but can also be largely determined by the way of combination structure of the entire speaker cabinet. Hence it is a subject of study and development done positively in the art to get both good quality of sound and good modeling, and there have been a lot of such structures for a long time.

Conventional speaker cabinets have their improvements; they have disadvantages in sound quality and apparent modeling though. One of the conventional speaker cabinets, for example, comprises mainly an integrally formed housing, the surface of a sound outlet of the housing is provided thereon with a plurality of excavated holes of irregular shapes, under them there is a concave curved surface being added thereon with a protecting netted lid having an integrally formed excavated hood covered with a surface downy cloth and a plurality of tenons for engaging with the excavated holes. Wherein, the integrally formed housing provided with the excavated holes has already an effect of protecting the speakers and dust-proofness as well as beauty when being used solely; it obtains a goal of fast changing in modeling by engagement and detachment between the excavated holes and the protecting netted lid, however, it still has the disadvantages stated below.

The disadvantages of conventional speaker cabinets are as follows:

1. The front panel is composed of a plurality of elements, e.g. front barrier, and the front barrier is mounted externally on the front panel. Accordingly, they will be inevitably loosened to create noise to affect the sound quality put out.
2. When a front cover and a rear cabinet are connected with each other, the intermediate connecting posts are only used for locking of speakers rather than offsetting the vibrating thrust in practice.
3. The bass reflex hole of a conventional speaker cabinet is provided in an open way and a vertical arrangement on the rear or the front panel of the cabinet, the requirement of providing a simple hole communicating the interior with the exterior of the cabinet is inevitable for the design for sound putting out, however, the hole does not have an effect of hiding and thereby will destruct the whole esthetic appearance of the cabinet, besides, water-proofness thereof is inferior.

SUMMARY OF THE INVENTION

The primary object of the present invention is to provide a front panel, a plurality of speakers which can tightly and integrally connected with a housing of a cabinet to strengthen the structure of the cabinet and can synchronically offset the frontward and rearward thrusts of the speakers to thereby provide an improved structure of speaker cabinet which can reduce vibration and elevate sound quality.

The secondary object of the present invention is to provide an improved structure of speaker cabinet having a kind of post which can directly get close to the speakers, the hollow space in the post can be filled therein with vibration absorbing material in order to generate an effect of vibration absorbing at the earliest time to reduce adverse vibration and noise.

Another object of the present invention is to provide an improved structure of speaker cabinet of which a rear reflex hole is provided as a hidden port just for being fittingly mounted therein an output line, in this way, the whole esthetic appearance can be improved and water-proofness of the speaker cabinet can be obtained.

To achieve the above stated objects, the improved structure of speaker cabinet of the present invention comprises mainly a housing opened on one side thereof and a front panel, wherein, the housing of the cabinet has a plurality of hollow posts located at the positions in correspondence with those of the connecting areas of a plurality of speakers, locking holes with reduced diameters are provided in front of the posts to abut on the front panel for locking. The housing of the cabinet has on the bottom thereof an integrally connected parallel passage of which the upper portion is communicated with the interior of the cabinet, and the lower portion is connected with the housing to form a hidden port communicating with the outside. The front panel is integrally provided with a front barrier, a plurality of speakers are provided on the front panel which has a plurality of locking holes thereon for alignment, hence the intermediate speakers can be held firm and get increased connecting strength when the front panel is integrally connected with the housing of the cabinet, and can offset the frontward and rearward thrusts of the speakers. And the hollow space in the posts can be filled therein with vibration absorbing material in order to reduce vibration at the earliest time. Such a design not only can reduce volume and weight of the cabinet, but also can improve sound quality and provide a hidden port to improve beauty as well as waterproofing effect of the cabinet.

The present invention will be apparent in its particular structural combination and functional characteristics in operation after reading the detailed description of the preferred embodiment thereof in reference to the accompanying drawings.

DETAILED DESCRIPTION OF THE PREFERRED EMBODIMENT

Figure 1:
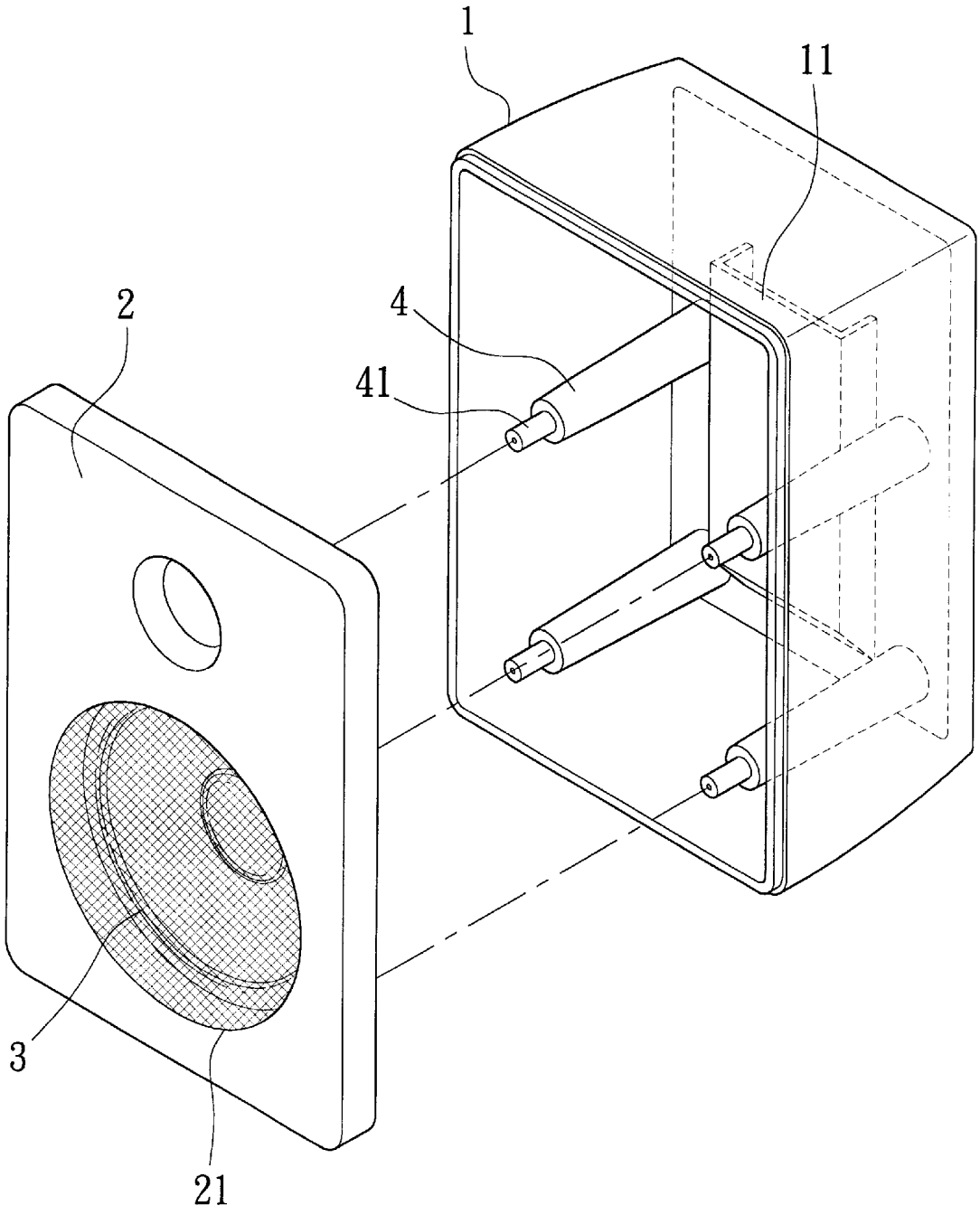
FIG. 1 is an analytical perspective view of the present invention.

Referring firstly to FIGS. 1–4, the improved structure of speaker cabinet of the present invention comprises mainly a housing 1 opened on one side thereof and a front panel 2, wherein:

The housing 1 has a plurality of hollow posts 4 located at the positions in correspondence with those of the connecting areas of a plurality of speakers 3, a locking hole 41 is formed on the front portion of each post with reduced diameters to abut on the front panel 2 for locking. The housing 1 of the cabinet has on the bottom thereof an integrally connected parallel passage 11 of which the upper portion is communicated with the interior of the cabinet, and the lower portion is connected with the housing 1 to form a hidden port 12 communicating with the outside.

The front panel 2 is integrally provided with a front barrier 21, a plurality of speakers 3 are provided on the front panel 2 which has a plurality of locking holes 22 thereon for alignment.

Figure 3:
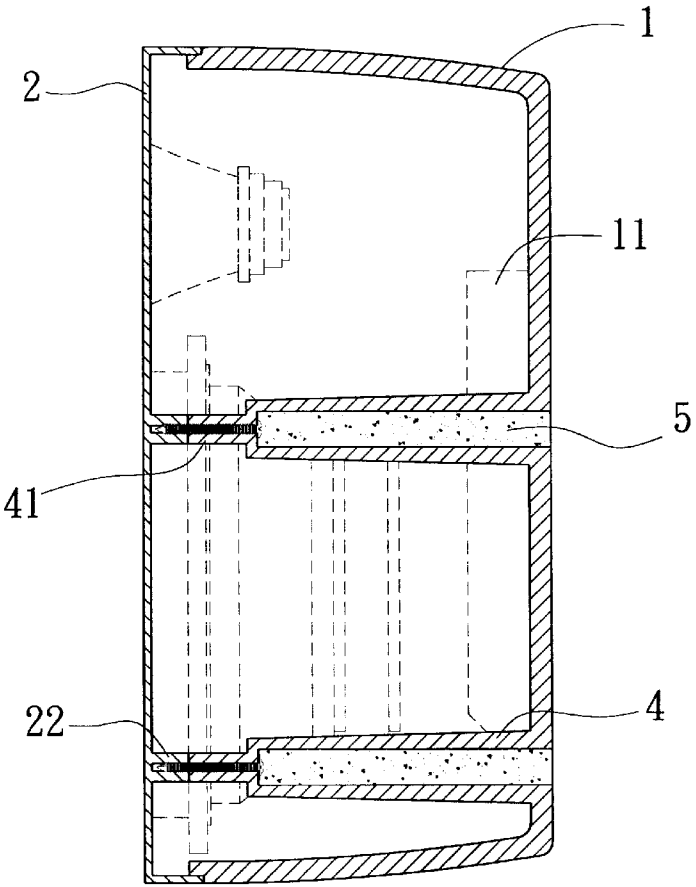
FIG. 3 is a sectional schematic view showing a post of the present invention is filled therein with vibration absorbing material.
Figure 2:
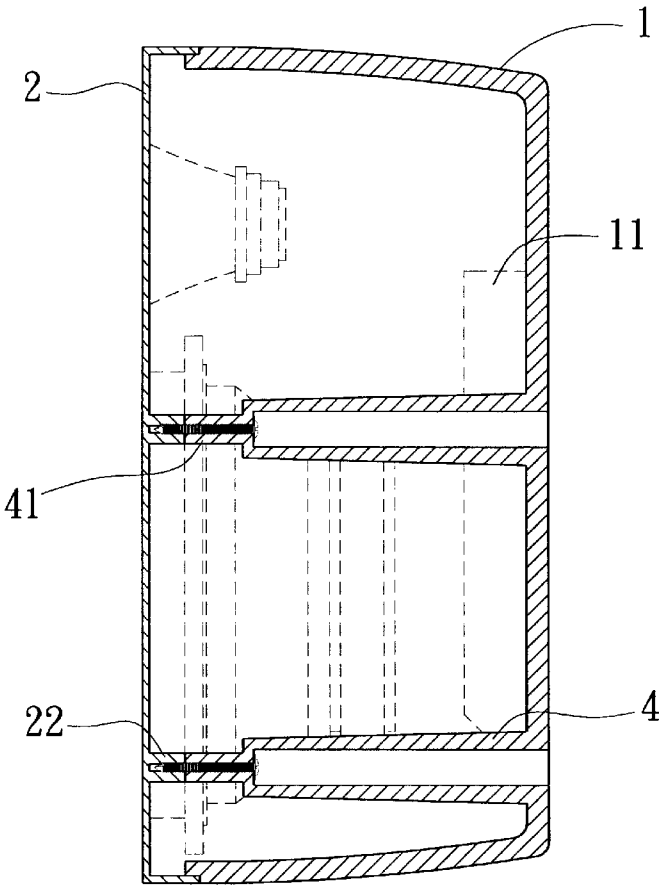
FIG. 2 is a plane view showing assembling of the present invention.

When in practice, the parallel passage 11 can be in the shape of reverse "U" and integrally connected on the bottom of the housing 1. There are totally four hollow posts 4 provided on the cabinet and are distributed on both sides of the passage 11. And as shown in FIG. 3, the hollow posts 4 also are filled therein with vibration absorbing material such as iron sand, sound absorbing cotton etc.

Thereby, when the front panel 2 and the speakers 3 are integrally connected with the housing 1, strength of the structure can be increased. The posts 4 are directly abutted against the front panel 2 and the housing 1 to offset the frontward and rearward thrusts of the speakers 3. And the posts 4 are close to the speakers 3, and the hollow space in the posts 4 can be filled therein with vibration absorbing material 5 in order to generate an effect of vibration absorbing at the earliest time to reduce adverse vibration and noise. Therefore, the quality of the sound out put can be improved.

Figure 5:
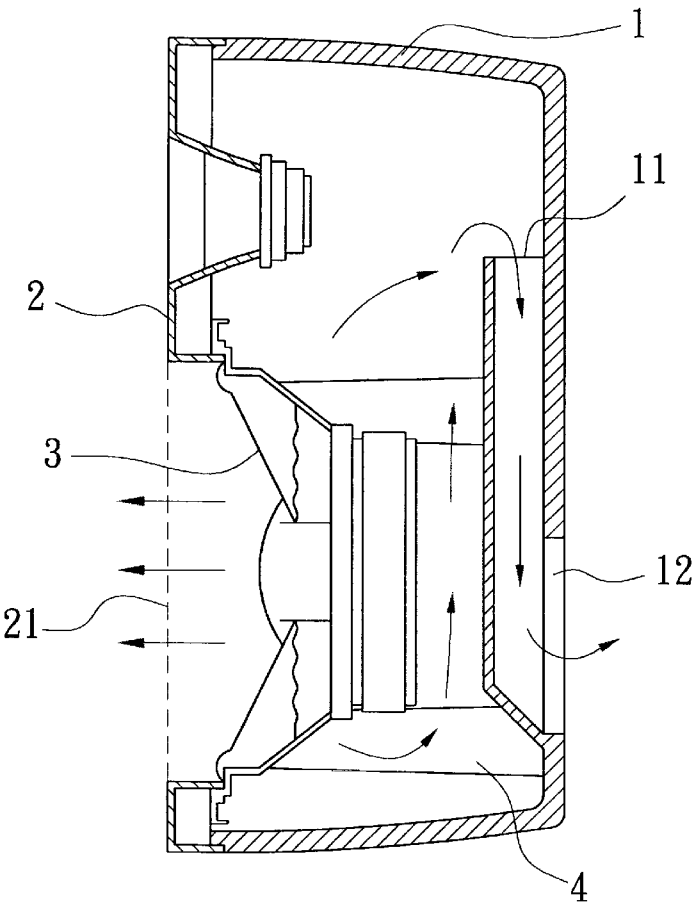
FIG. 5 is a sectional schematic view showing applying of the present invention.
Figure 4:
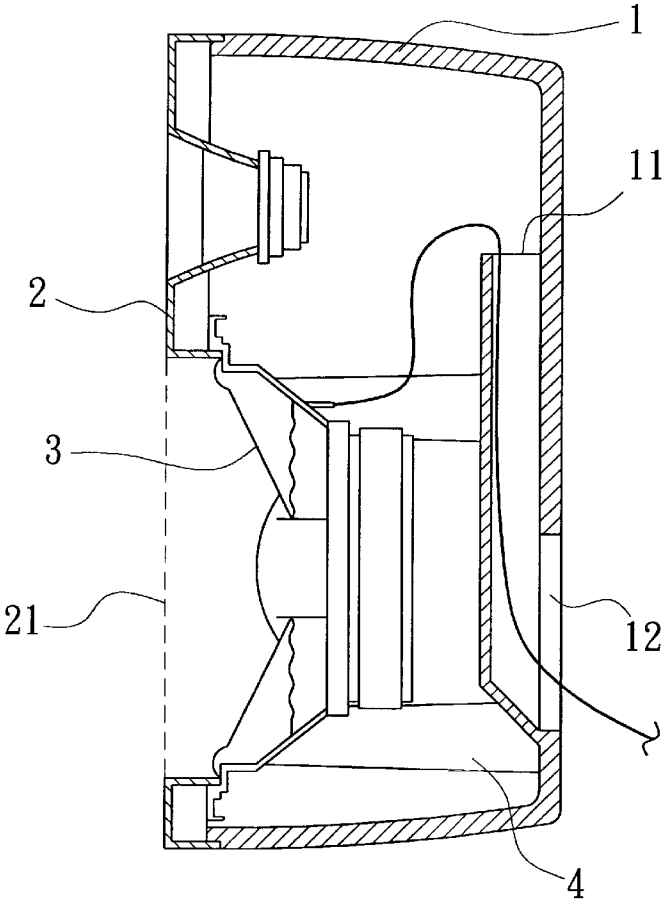
FIG. 4 is a sectional schematic view showing a hidden reflex hole of the present invention for being mounted therein an output line.

And as shown in FIGS. 4 and 5, the improved structure of speaker cabinet of the present invention has the parallel passage 11 in the shape of reverse "U-like" and integrally connected on the bottom of the housing 1, thereby, defects of a conventional sound hole which is provided in an open way and in a vertical arrangement are eliminated; further, the hidden port 12 is provided just for being fittingly mounted therein an output line, in this way, the bass reflex hole of the speaker cabinet after assembling can be obscured very well so that the whole esthetic appearance can be improved, and water-proofness of the speaker cabinet can be obtained by that pushing airflow generated in outputting of the speakers 3 in practice can be suitably adjusted by communication of the parallel passage 11 with the outside and thereby will not affect the normal outputting. The terminal hidden port 12 communicating with the interior is located at a higher place; waterproofing effect thereof hence is excellent.

In conclusion, the present invention is novel and practical structurally; its combination is simple and firm and effective, in addition to increasing of the strength of combination, sound quality is improved; the hidden port can improve beauty as well as water-proofing of the speaker cabinet, hence it is functionally far superior than a conventional cabinet.

Having thus described the technical structure of my invention, the structure has never existed in the markets, therefore, what I claim as new and desire to be secured by Letters Patent of the United States are:

1. A speaker cabinet comprising:

a housing and a front panel, said panel opened on one side thereof and having a plurality of hollow posts located at the positions in correspondence with those of the connecting areas of a plurality of speakers, said posts abut on said front panel for locking, said housing of said cabinet has on the bottom thereof an integrally connected parallel passage of which the upper portion is communicated with the interior of said cabinet, and the lower portion is connected with said housing to form a hidden port communicating with the outside;

said front panel integrally provided with a front barrier, said speakers are provided on said front panel which has a plurality of locking holes thereon for alignment;

wherein, said posts are filled therein with vibration absorbing material.

2. A speaker cabinet as in claim 1, wherein, each of said posts has a locking hole formed on the front portion with reduced diameters.

* * * * *